United States Patent [19]

Heintzmann et al.

[11] Patent Number: 4,572,480

[45] Date of Patent: Feb. 25, 1986

[54] HYDRAULIC PROP

[75] Inventors: Peter Heintzmann, Bochum; Manfred Koppers, Duisburg; Friedel Amling, Gelsenkirchen-Buer; Karlheinz Bohnes, Bochum, all of Fed. Rep. of Germany

[73] Assignee: Rochumer Eisenhuette Heintzmann GmbH & Co. KG, Bochum, Fed. Rep. of Germany

[21] Appl. No.: 548,075

[22] Filed: Oct. 31, 1983

[30] Foreign Application Priority Data

Dec. 7, 1982 [ZA] South Africa ..... 82/8996

[51] Int. Cl.[4] ..... B66F 3/24

[52] U.S. Cl. ..... 254/93 R; 248/357

[58] Field of Search ..... 248/357, 354.1, 351; 254/93 R; 405/290

[56] References Cited

U.S. PATENT DOCUMENTS

| | | | |
|---|---|---|---|
| 2,992,477 | 7/1961 | Duncan et al. | 254/93 R X |
| 3,426,995 | 2/1969 | Allinquant | 254/93 R X |
| 4,076,214 | 2/1978 | Colly | 254/93 R |
| 4,142,449 | 3/1979 | Koppers et al. | 254/93 R X |
| 4,404,893 | 9/1983 | Sigott et al. | 254/93 R X |

FOREIGN PATENT DOCUMENTS

| | | | |
|---|---|---|---|
| 704500 | 2/1965 | Canada | 254/93 R |
| 1192141 | 5/1965 | Fed. Rep. of Germany | 254/93 R |
| 1209532 | 1/1966 | Fed. Rep. of Germany | 254/93 R |
| 101634 | 4/1964 | Norway | 254/93 R |
| 1038453 | 8/1966 | United Kingdom | 248/357 |
| 576287 | 10/1977 | U.S.S.R. | 254/93 R |
| 870730 | 10/1981 | U.S.S.R. | 405/290 |

*Primary Examiner*—J. Franklin Foss

*Attorney, Agent, or Firm*—Michael J. Striker

[57] ABSTRACT

An hydraulic prop utilized for barricades in blasting operations that affords simplified mounting and dismantling and will have minimal functional inefficiency if deformed by the impact of rocks; and it can be made out of unworked pipe of minimal standards. Two specific guide regions disposed on the piston are spaced large enough from each other that comparatively wide tolerances can be achieved between the piston and the cylinder.

20 Claims, 4 Drawing Figures

HYDRAULIC PROP

BACKGROUND OF THE INVENTION

The present invention relates to an hydraulic prop. More particularly, it relates to an hydraulic prop, having a piston, a cylinder, sealing apparatus and accessibility for the entrance and exit of hydraulic fluid.

Hydraulic props of the above mentioned general type are known in the art and serve greatly in facilitating the erection and change of barricades in underground areas where shooting and blasting are carried out, such as in South African gold mines where there is a need for attaching barricades. These props require pistols for setting and wrenches for removal. Adjacent structural forms must be protected. The props can experience failure created by overloaded fluid pressure, rock shifting and damage from the impact of stones. If a prop is damaged and can no longer function properly, it must be replaced or repaired, both being very costly.

SUMMARY OF THE INVENTION

Accordingly , it is an object of the present invention to provide an hydraulic prop which avoids the disavantages of the prior art.

More particularly, it is an object of the present invention to provide an hydraulic prop, which is realiable and is simple to mount and dismantle and will have minimal functional inefficiency if deformed by the impact of rocks and can also be constructed from unworked pipe of minimal standards.

In keeping with these objects, and with others, which will become apparent hereinafter, one feature of the present invention resides, briefly stated, in an hydraulic prop having a piston, a cylinder, sealing apparatus and accessibility for the entrance and exit of hydraulic fluid, wherein the upperannular collar and the inner surface of the cylinder form a passage for the hydraulic fluid to enter the compression chamber.

When the hydraulic prop is designed in accordance with the present invention, fluid can be introduced through the passage directly into the compression chamber without the need for extensive hydraulic valving and routing and would therefore eliminate any possible turbulance and foaming of the hydraulic fluid which would lead to its eventual failure.

In accordance with another feature of the present invention, a hook is disposed on the cylinder to be used for attaching the hydraulic prop to barricades.

Still another feature of the present invention is that the upper and lower annular collars are formed partially by built up welding.

A further feature of the present invention is that the split wiping ring contains teeth that protect the inner surface of the split wiping ring from contaminating particles that may be on the piston surface.

Finally, still a further feature of the present invention is that the first and second plates are convexed in shape and may contain etchings to increase the gripping power of the hydraulic prop and reduce the chances its slippage.

The novel features which are considered as characteristic for the invention are set forth in particular in the appended claims. The invention itself, however, both as to its construction and its method of operation, together with additional objects and advantages, thereof, will be best understood from the following description of specific embodiments when read in connection with the accompanying drawing.

DETAILED DESCRIPTION OF THE PREFERRED EMBODIMENT

Figure 1:
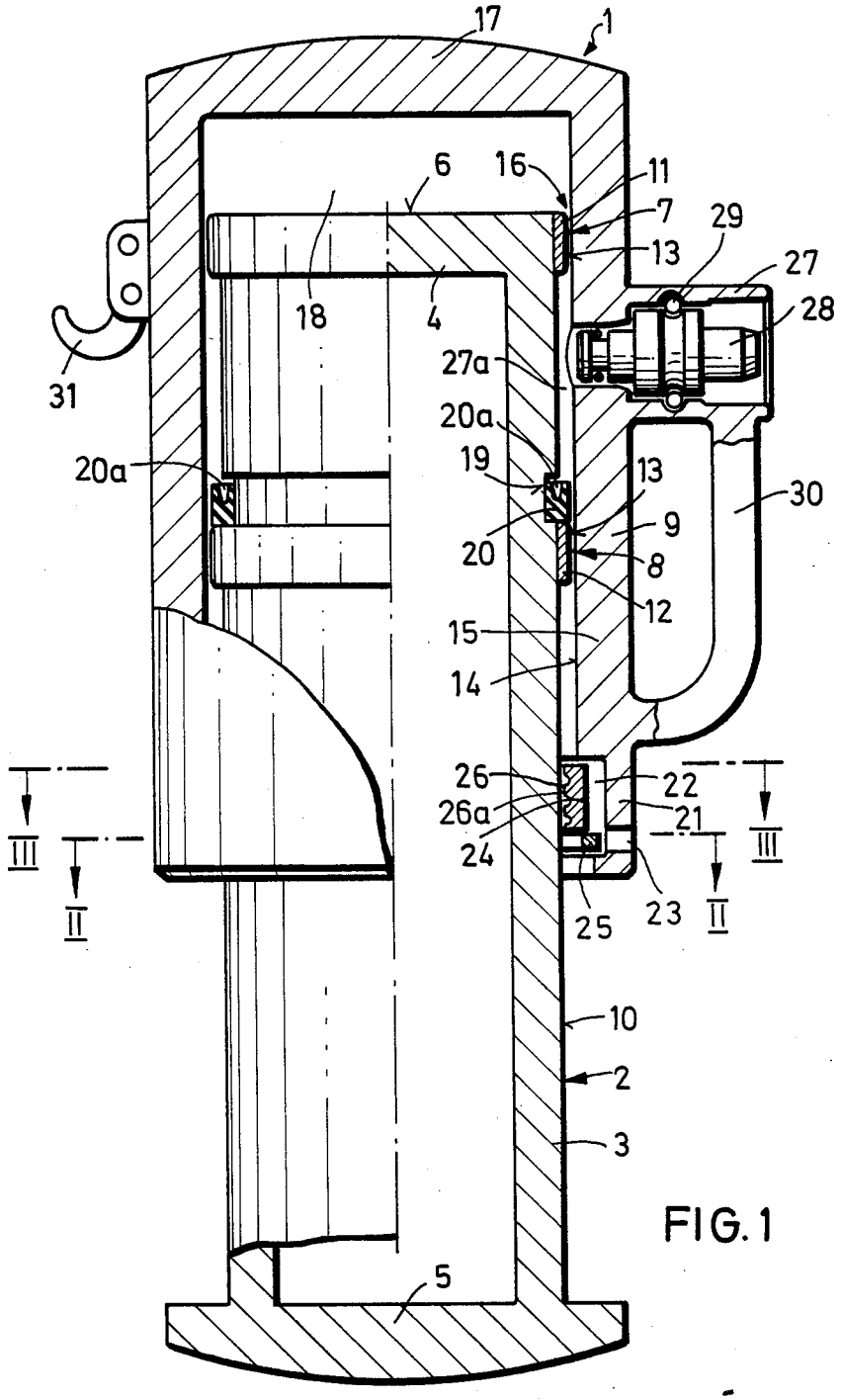
FIG. 1 is an elevational view in partial section of the hydraulic prop of the present invention.

Referring now to FIG. 1, the hydraulic prop of the present invention is shown generally at 1 having a pipe-shaped piston 2. The piston 2 is constructed from a pipe section 3 having two plates 4 and 5, welded to its ends to form a closed unit. The top plate 4 closes the piston 2 at the top end to form a piston surface 6 of the hydraulic prop 1. The bottom plate 5 assumes a convex shape and may be provided with etching for better gripping power and minimal chances of slippage.

On the periphery of the piston 2 are disposed two guide regions 7, 8. The two guide regions 7, 8 are spaced such that the guide region 7 is in line with the top surface 6 of piston 2. The guide regions 7, 8 separate the piston 2 from an overlapping cylinder 9 and further provide an area of displacement between the piston 2 and the cylinder 9. The guide regions 7, 8 are formed substantially from two annular collars 11, 12. The collars 11, 12 encompass the perphery of, and project from an outer surface 10 of the piston 2. Annular collars 11, 12 are formed by weldings, which are consecutively built up until a peripheral surface 13 is formed on the collars 11, 12. The surface 13 allows the cylinder 9 to slide efficiently relative to the piston 2.

The upper annular collar 11, together with a projectionless inner surface 14 of an outer prop wall 15 form a passage 16. The passage 16 allows the hydraulic fluid to enter a compression chambers 18. The compression chamber 18 is formed by the top surface 6 of the piston 2, walls 15 of the cylinder 9 and the top end plate 17 of the cylinder 9. The top end plate 17 assumes a convex shape and may also be etched to increase its gripping power and minimize its chance for slippage.

The lower annular collar 12 separates that portion of the piston 2 which is in communication with the fluid from the ambient.

In addition to the lower annular collar 12 and to further ensure against leakage of the fluid, there is provided a sealing ring 20 which is seated in an anular groove 19. The annular groove 19 forms a land on the outer surface 10 of the piston 2. It is necessary that the wall thickness of the piston 2 remain thick enough so as not to be weakened by the presence of the annular groove 19.

The sealing ring 20 is the lip type, having lips **20*a* each of which point towards the top plate 4 of the piston 2**.

At the free bottom end 21 of the cylinder 9, there is disposed an inner circumferential groove 22. A transverse through bore 23 open to the ambient and disposed at the free bottom end 21 allows accessibility to the circumferential groove 22.

Figure 3:
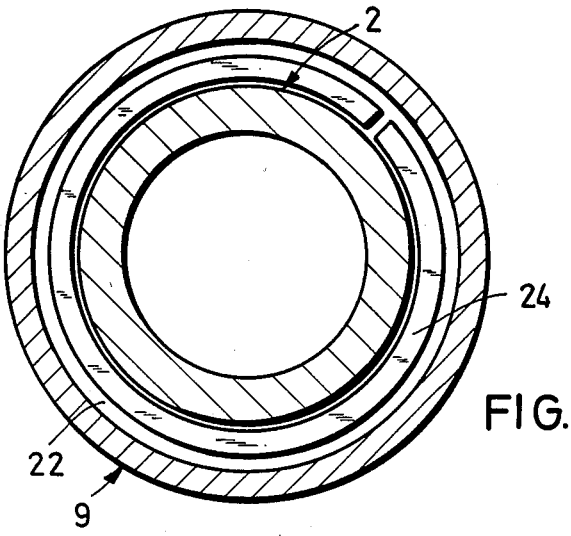
FIG. 3 is a cross section of the hydraulic prop of the present invention taken along line III—III of FIG. 1.
Figure 2:
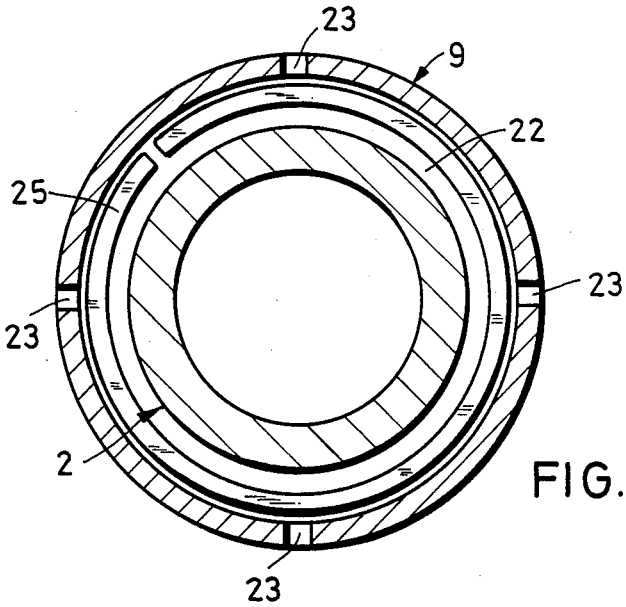
FIG. 2 is a cross section of the hydraulic prop of the present invention taken along line II—II of FIG. 1.

As shown in FIGS. 2 and 3, disposed in the circumferential groove 22 is a split wiping ring 24, preferably metallic, and a split lock ring 25. The lock ring 25 biases the wiping ring 24 in an axial position and prevents any axial movement, but does allow for radial movement. Through the throughbore 23, suitable tools can be inserted to compress the lock ring 25 for the purpose of dismantling and removing the wiping ring 24. The wiping ring 24 provides a limiting stop for the travel of the piston 2 and also has the additional function of wiping dirt from the outer surface 10 of the piston 2. This wiping action minimizes contamination of the hydraulic fluid and damage to the interior the interior workings of the hydraulic prop 1. The contamination could internally scratch the piston 2 and its working components in addition to wearing out the sealing ring 20 and other relevant parts.

In FIG. 1, it is shown that the wiping ring 24 has teeth 26*a* preferably disposed on its inner side 26. The use of superimposing rib formations on the wiping ring 24 can produce the desired teeth 26*a*. The teeth 26*a* allows the wiping ring 24 to pass over contamination on the piston 2 by causing wiping ring 24 to be displaced into the groove 22 when contamination particles are encountered.

A valve 28 is provided in a housing 27. The housing 27 is casted integrally with and is radially attached to the cylinder 9. The valve 28 is provided to create access for filling, withdrawing, and releasing excess pressure of the hydraulic fluid. The valve 28 is detachably mounted in the housing 27 and held in place by a U-shaped clamp 29.

By relieving the valve 28, hydraulic fluid can be introduced through the housing 27 and into an annular chamber 27*a*. Annular chamber 27*a* is the region defined by the piston 2, the cylinder 9 and the guide regions 7, 8. Once the fluid enters the annular chamber 27*a* it passes through the passage 16. The passage 16 is bordered by the upper guide region 7 and the inner surface 14 of the cylinder 9. As the fluid passes through the passage 16 it enters the compression chamber 18 of the hydraulic prop.

Figure 4:
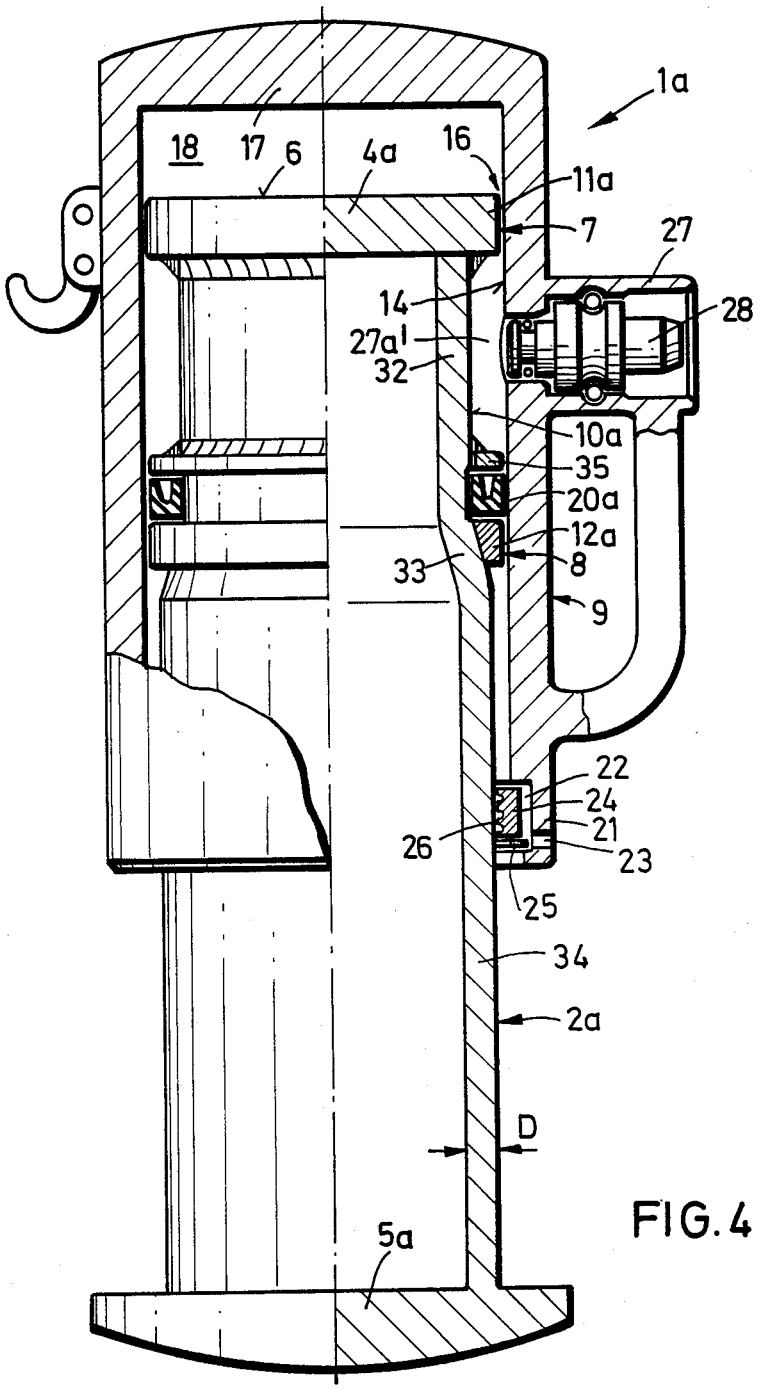
FIG. 4 is an elevational view in partial section of an alternate embodiment of the hydraulic prop.

In an alternate embodiment as shown in FIG. 4, where identical structured components to that of the preferred embodiment contain identical reference numerals, the construction is similar in certain ways to the embodiment depicted in FIGS. 1–3. Similarities in particular find themselves in the construction and location of the valve 28 as it is also disposed in the radially attached housing 27. Also, the wiping ring 24 is still disposed at the bottom end 21 of the cylinder 9. Additionally, there are also two guide regions 7, 8 on a modified piston 2*a*. Additionally, in this embodiment, the end plates 4*a* and 5*a* of the modified piston 2*a*, and the end plate 17 of the cylinder 9 are welded to the ends of the respective pipe-shaped wall regions.

However, the major difference in the alternate embodiment exists in the configuration of the modified piston 2*a*. The upper region of the modified piston 2*a* contains a reduced longitudinal portion 32. The amount of reduction of the reduced logitudinal portion 32 of the modified piston 2*a* corresponds approximately to a wall thickness D of the modified piston 2*a*. The wall thickness D is limited to the minimal dimension necessary to ensure structural integrity. Because of the reduction in the upper region of the modified piston 2*a*, an area 27*a* is greatly increased and provides a large clearance between the modified piston 2*a* and the cylinder 9. Due to this increased clearance, there is negated the need for a substantial annular groove to be made in a outer surface 10*a* of modified piston 2*a* for the seating of a sealing ring 20*a*. With the absence of an annular groove, the retaining ring 35 is utilized to secure the sealing ring 20.

The retaining ring 35 is welded to the periphery of the modified piston 2*a* adjacent to an annular collar 12*a*. The annular collar 12*a* is disposed in a tapered region 33. The tapered region 33 is defined as that area between the reduced longitudinal portion 32 and a wider logitudinal portion 34.

It will be understood that each of the elements described above, or two or more together, may also find a useful application in other types of construction differing from the types described above.

While the invention has been illustrated and described as embodied in a HYDRAULIC PROP, it is not intended to be limited to the details shown, since various modifications and structural changes may be made without departing in any way from the spirit of the present invention.

Without analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An hydraulic prop for supporting barricades in blasting operations, comprising:

a pipe-shaped piston having an outer surface and a top end, with a top surface, and arranged to be supported on a support;

a pipe-shaped cylinder having a top end plate, and an inner surface without projections, said top end plate of said cylinder forming together with said top surface of said piston a pressure chamber, said cylinder being mounted on said piston so that said cylinder and said piston are displaceable relative to one another between extended and retracted positions;

a valve arranged to said pressure chamber, so as to define a fluid-wetted region of said piston and cylinder; and upper and lower vertically spaced guide regions disposed at the upper end of said piston and consisting of only an upper and a lower circumferentially disposed annular collar both projecting from said outer surface of said piston and located in said fluid-wetted region, said upper annular collar of said piston forming together with said cylinder a passage for said hydraulic fluid to pass from said valve through said fluid wetted region to said pressure chamber, and said lower annular collar separating said fluid-wetted region of said piston and said cylinder from the atmosphere.

2. The hydraulic prop as in claim 1, further comprising attachment means disposed on said cylinder for attaching to barricades.

3. The hydraulic prop as in claim 1, wherein said upper and lower annular collars are formed partially by built up welding.

4. The hydraulic prop as in claim 1, further comprising a sealing ring disposed adjacent to said lower annular collar.

5. The hydraulic prop as in claim 4, wherein said outer surface of said piston has an annular groove above said lower annular collar, said sealing ring being seated at least partially in said annular groove.

6. The hydraulic prop as in claim 1, further comprising a housing which is radially attached to said cylinder, said valve being removable mounted in said housing.

7. The hydraulic prop as in claim 6, wherein said valve has a longitudinal axis radially disposed directly above said lower annular collar when said hydraulic prop is in said retracted position.

8. The hydraulic prop as in claim 1, wherein said piston has a free hollow end; further comprising a split wiping ring having an inner surface, said split wiping ring being disposed on said free bottom end of said piston.

9. The hydraulic prop as in claim 8, wherein said cylinder has an inner circumferential groove further comprising a split-ring said split ring axially securing said split wiping ring in said inner circumferential groove of said cylinder.

10. The hydraulic prop as in claim 8, wherein said split wiping ring has teeth that project from said inner surface of said split wiping ring.

11. The hydraulic prop as in claim 1, wherein said cylinder has a circumferential groove and a throughbore disposed perpendicular to said circumferential groove for access to ambient.

12. The hydraulic prop as in claim 1, wherein said piston has a first plate and a top surface, said first plate forming said top surface of said piston.

13. The hydraulic prop as in claim 1, wherein said piston has a bottom surface and a second plate, said second plate forming said bottom surface of said piston.

14. The hydraulic prop as in claim 13, wherein said first and second plates have external convexed surfaces.

15. The hydraulic prop as in claim 14, wherein said exterior convexed surfaces are roughened so that said hydraulic prop wil have increased gripping power.

16. The hydraulic prop as in claim 1, wherein said piston has a reduced portion at said top end of said piston.

17. The hydraulic prop as in claim 16, further comprising a retaining ring disposed on the perphery of said reduced portion of said piston.

18. The hydraulic prop as in claim 17, wherein said sealing ring is seated between said lower annular collar and said retaining ring.

19. The hydraulic prop as in claim 16, wherein the amount of reduction in diameter of said reduced portion of said piston is approximately equal to the wall thickness of said piston.

20. An hydraulic prop for supporting barricades in blasting operations, comprising:

a pipe-shaped piston having an outer surface, a free bottom end and a top end with a top surface, and arranged to be supported on a support;

a pipe-shaped cylinder having a top end plate, and an inner surface without projections, said top end plate of said cylinder forming together with said top surface of said piston a pressure chamber, said cylinder being slidably mounted on said piston so that said cylinder and said piston are diplaceable relative to one another between extended and retracted positions;

attachment means disposed on said cylinder for attaching to barricades;

a housing which is radially attached to said cylinder;

a valve arranged to said pressure chamber so as to define a fluid-wetted region of said piston and cylinder, said valve being removably mounted in said housing and having a longitudinal axis radially disposed directly above said lower annular collar when said hydraulic prop is in said retracted position;

upper and lower vertically spaced guide regions disposed at the upper end of said piston, said guide regions containing an upper and a lower circumferentially disposed annular collar, said collars projecting from said outer surface of said piston, said upper annular collar of said piston forming together with said cylinder a passage for said hydraulic fluid to pass to said pressure chamber, and said lower annular collar separating said fluid-wetted region of said piston and said cylinder from the atmosphere;

and a split wiping ring having an inner surface, said split wiping ring being disposed on said free bottom end of said piston.

* * * * *